US008985384B2

(12) United States Patent
Cheetham et al.

(10) Patent No.: US 8,985,384 B2
(45) Date of Patent: Mar. 24, 2015

(54) LIQUID CONTAINER

(75) Inventors: Joshua James Cheetham, Windsor (AU); Amanda Jane Cosgriff, Glenhuntly (AU); Anthony Brian Clayton, Hughesdale (AU)

(73) Assignee: SDI North America Inc., Bensenville, IL (US)

( * ) Notice: Subject to any disclaimer, the term of this patent is extended or adjusted under 35 U.S.C. 154(b) by 0 days.

(21) Appl. No.: 13/527,746

(22) Filed: Jun. 20, 2012

(65) Prior Publication Data

US 2012/0325813 A1 Dec. 27, 2012

(30) Foreign Application Priority Data

Jun. 24, 2011 (AU) ..... 2011902493

(51) Int. Cl.
*B65D 43/04* (2006.01)
*B65D 1/02* (2006.01)
*B65D 39/16* (2006.01)

(52) U.S. Cl.
CPC ..... *B65D 1/0223* (2013.01); *B65D 39/16* (2013.01); *B65D 2501/0081* (2013.01)
USPC ..... 220/801; 220/805; 215/296

(58) Field of Classification Search
USPC ..... 220/212.5, 801, 802, 804, 805, 787, 220/788, 800; 215/296, 305
See application file for complete search history.

(56) References Cited

U.S. PATENT DOCUMENTS

| | | | | | |
|---|---|---|---|---|---|
| 52,269 | A * | 1/1866 | Connelly | 215/356 |
| 2,914,207 | A * | 11/1959 | Moore | 215/270 |
| 4,182,458 | A * | 1/1980 | Meckler | 215/307 |
| 5,944,208 | A * | 8/1999 | Gale | 215/296 |

* cited by examiner

*Primary Examiner* — Jeffrey Allen
(74) *Attorney, Agent, or Firm* — William H. Holt

(57) ABSTRACT

A container (10) has a base (12) on a cap (14). The container (10) has a chamber (38) for liquid. The base (12) on the cap (14) are arranged to be interengaged so as to seal hermetically the chamber (38). The base (12) and the cap (14) have multi-sided portions which interengaged to form the hermetic seal. The cap (14) has outwardly flared sides so that as the cap (14) is rotated relative to the base (12) the cap is caused to move out of the base and the hermetic seal is broken so that the contents of the chamber (38) may be accessed.

9 Claims, 5 Drawing Sheets

LIQUID CONTAINER

The present invention relates to a container.

SUMMARY OF THE INVENTION

In accordance with one aspect of the present invention there is provided a container comprising a base and a cap, the base having a lower end and an upper end and the cap having a lower end and an upper end, wherein the base and the cap are arranged to be interengaged to form a hermetic seal such that a chamber within the base adjacent the lower end thereof, arranged to contain liquid, is sealed off, the base having a multi-sided upper region adjacent the upper end thereof and the cap having a corresponding multi-sided upper region adjacent the upper end thereof, the respective upper regions being snugly engaged when the base and the cap are hermetically interengaged, the upper region of the cap being flared outwardly progressively towards the upper end of the cap and the base having a multi-sided upper end wall, wherein the interengaged cap may be rotated axially within the base so as to cause the cap to rise up over the upper end wall of the base and to be released from the base.

The multi-sided components of the container may not be circular but may have one of a wide range of other shapes such as oval, triangular, quadrangular, pentagonal or hexagonal.

DESCRIPTION OF THE DRAWINGS

The present invention will now be described, by way of example, with reference to the accompanying drawings, in which.

DESCRIPTION OF THE INVENTION

Figure 1:
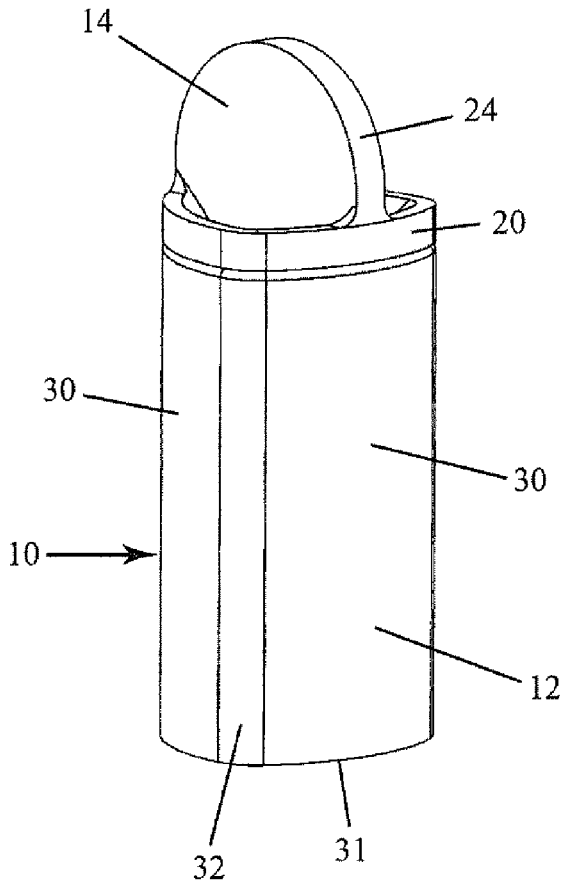
FIG. 1 is a perspective side elevation of a liquid container in accordance with the present invention.

In the drawings there is shown a container 10 comprising a base 12 and a cap 14.

As can be seen in FIGS. 1 to 4, the cap 14 comprises an elongated hollow body 16. As can also be seen in FIGS. 3 and 4, the cap 14 has a first lower end 17. An outer wall 18 extends from the first lower end 17 to a second upper end 19 which is provided with an outwardly extending endless rim 20.

Figure 4:
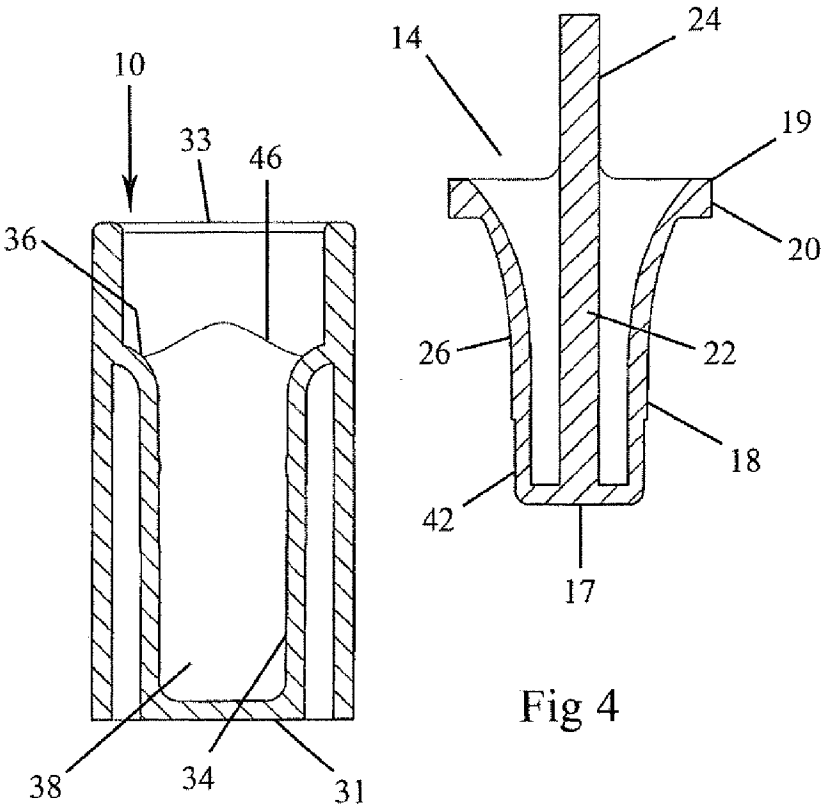
FIG. 4 is a vertical sectional view of the container of FIG. 3 in front elevation.
Figure 3:
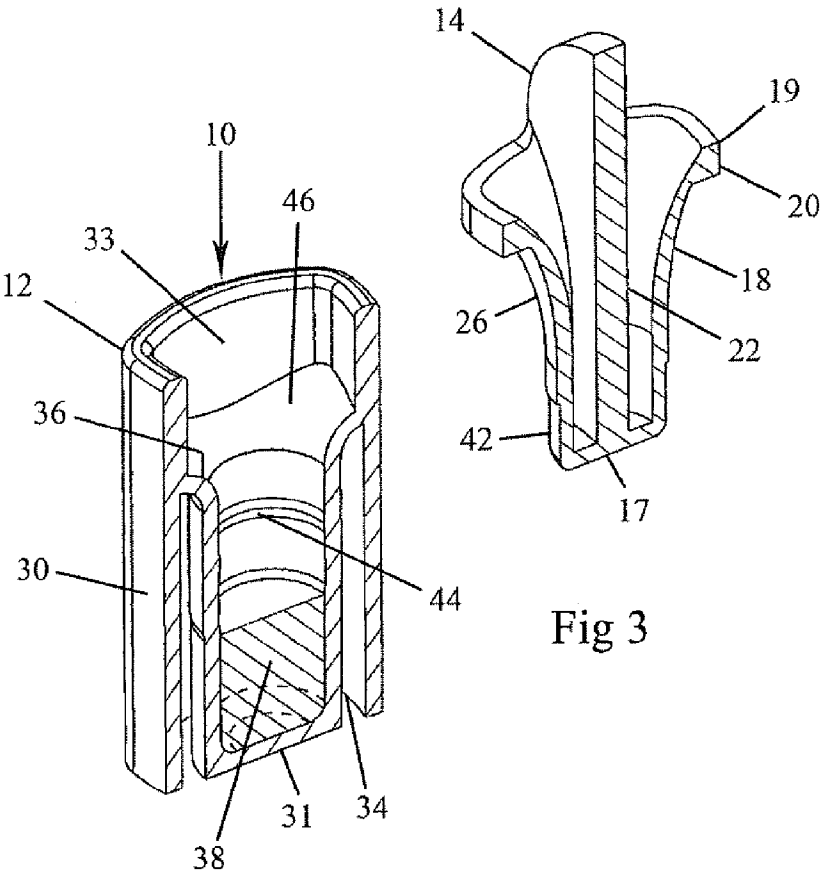
FIG. 3 is a vertical sectional view of the container of FIG. 1 in perspective showing the cap and the base in separated condition.

Further, as can be seen in FIGS. 3 and 4, a flange 22 extends from the first lower end 17 to the second upper end 19 within the cap 14. The flange 22 then extends beyond the second end 19 to form an upstanding handle member 24. The handle member 24 is arranged to enable the cap 14 to be rotated axially such as by manual means.

The outer wall 18 has a plurality, in this case three, (two of which can be seen in FIG. 2), substantially identical faces 26 in an upper region thereof adjacent to the rim 20 at the upper end 19. As can be seen in the drawings the faces 26 flare outwardly progressively towards the upper end 19. Further, below the faces 26, the outer wall 18 has a generally cylindrical shape.

Figures 2, 2A:
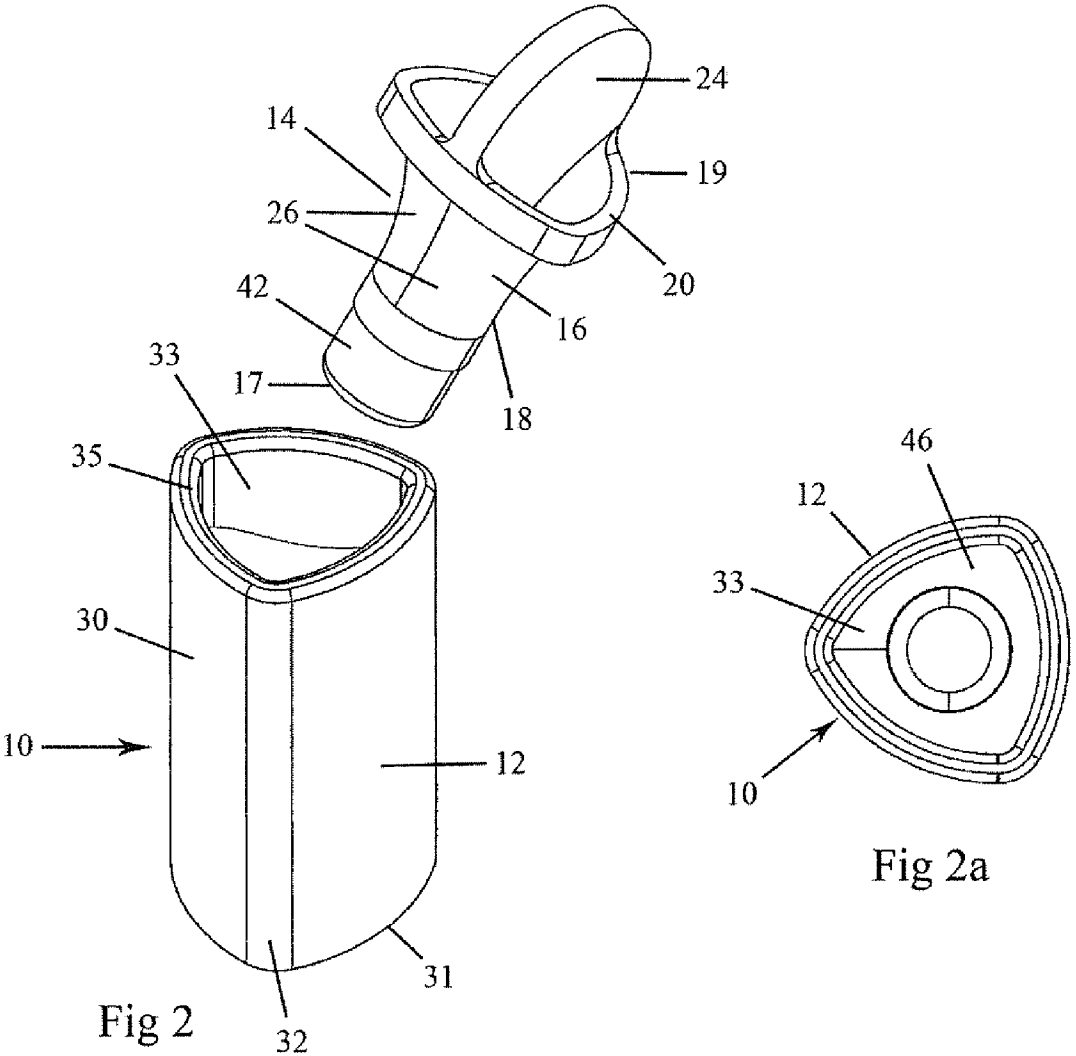
FIG. 2 is a view similar to FIG. 1 with a cap removed from a base.
FIG. 2*a* is a plan view of the base of FIG. 2.

Further, as can be seen in FIG. 2, the base 12 has a generally three-sided triangular shape in plan view in which outer sides 30 are joined at apices 32 of the triangular shape. The base 12 has a lower end 31 and an open upper end 33.

As can be seen in FIGS. 3 and 4, within the base 12 there is mounted an inner circular wall 34. The wall 34 is connected to the outer sides 30 of the base 12 adjacent an upper end of the wall 34 by an outwardly extending circular flange 36. The flange 36 acts as a guide for insertion of the cap 14. The inner circular wall 34 defines a generally cylindrical liquid containing chamber 38 of the container 10 as can be seen by the liquid 40 shown in FIGS. 5 and 6.

Further, the cap 14 is provided with a sealing means such as a circumferential sealing plate 42 in the lower cylindrical portion which extends around the periphery, the lower cylindrical portion adjacent to the lower end 17 of the cap 14. Further, the chamber 38 contains a sealing means such as a circumferential sealing ring 44.

Figure 6:
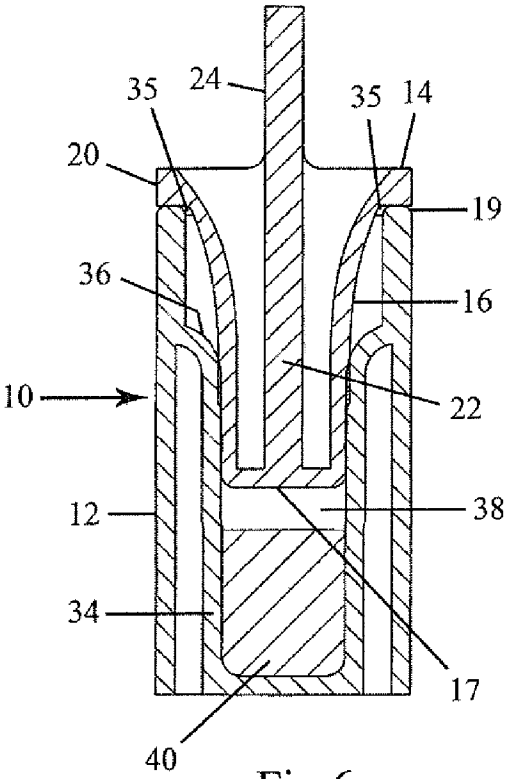
FIG. 6 is a view similar to FIG. 4 with the cap and base inter-engaged.
Figure 5:
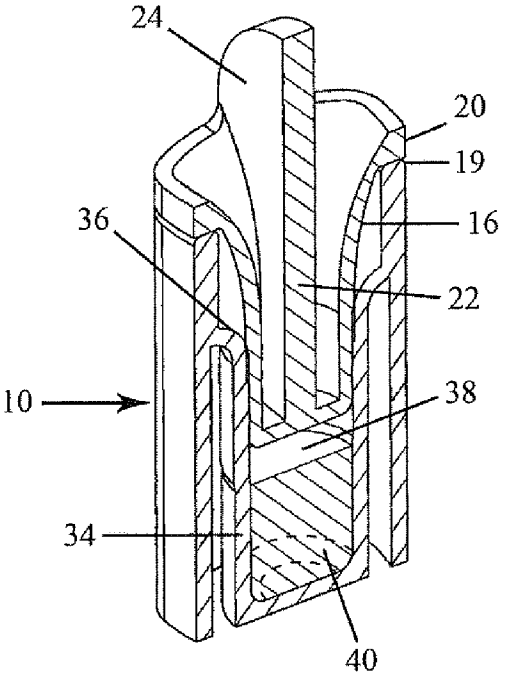
FIG. 5 is a view similar to FIG. 3 with the cap and base inter-engaged.
Figure 7:
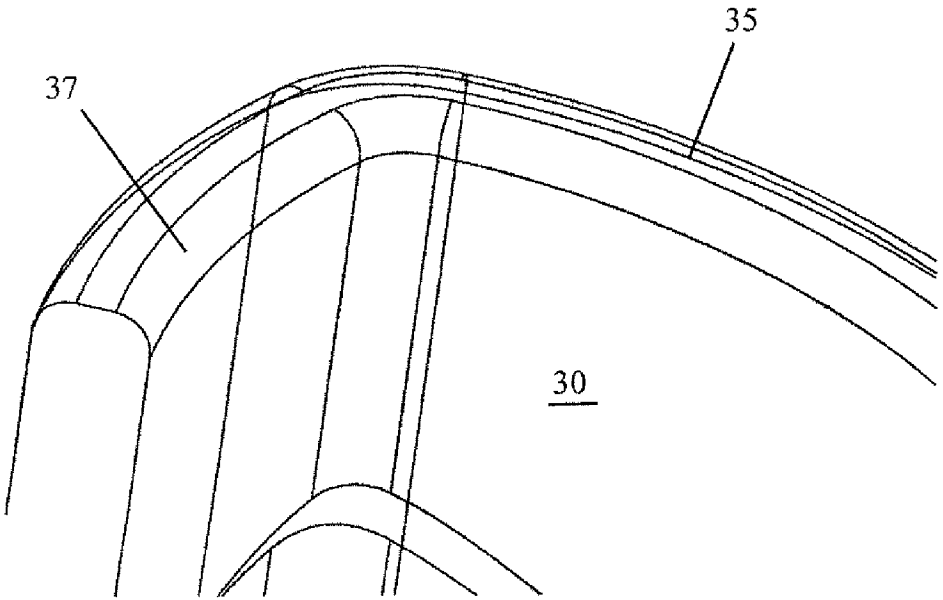
FIG. 7 is a perspective view to an enlarged scale of a portion of an upper end of the base showing a curved inner profile thereof.

Still further, the outer sides 30 have upper ends 35 which have respective inner edges in the form of curved lips such 37 as radiused lips (see FIG. 7). As can best be seen in FIGS. 5 and 6, when the container 10 is assembled the upper ends 35 are in engagement with an underside of the rim 20. As can be seen in FIGS. 5 and 6, the outwardly flared upper ends of the faces 26 are adjacent the upper end 33 of the base 12 in the assembled condition of the container 10.

In use, the cap 14 is pushed into the base 12 until the circumferential sealing ring 44 engages with the circumferential sealing ring 42. Thus, in the condition shown in FIGS. 5 and 6, in which the cap 14 is interengaged with the base 12, the sealing rings 42 and 44 are in engagement with one another and the chamber 38 containing liquid 40 is hermetically sealed. This protects the contents of the chamber 38 from the atmosphere and, if the container 10 is opaque, also from the ambient light. In this condition the flared upper end of the cap 14 is snugly engaged with the inner sides 36 of the ends 35 of the outer walls 30.

The base 12 contains a surface 46 (see FIGS. 2*a*, 3 and 4) adjacent the open end 33. The surface 46 has a respective relatively elevated portion adjacent each apex 32 of the base 12 as shown in FIG. 4.

Further, in use, in the condition shown in FIGS. 5 and 6, the cap 14 is rotated clockwise or anticlockwise such as by manual means so as to force the faces 26 to move relatively to the curved lips 37 of the upper edges 35. As relative rotation of the cap 14 and the base 12 is continued the faces 26 rise up over the curved lips 37 causing the cap 14 to be moved out of the base 12 and the hermetic seal to be broken.

By way of explanation, as the cap 14 has a body 16 with a number of faces 26 and the base 12 has a number of upper ends 35 having internal sides, and the cap 14 and the base 12 are arranged to fit together snugly, it is not possible for the cap 14 to be simply rotated within the base 12. There is an interference between the side 26 and a curved edge 37 such that the flared shape of a side 26 engaging with a curved lip 37 results in outward movement of the cap 14 from the base 12 when the handle member 24 is axially rotated.

It is envisaged that the liquid container be of general applicability but it is particularly envisaged for use with dental adhesives or liquid dental materials.

Further, it is envisaged that the container 10 could contain a plurality of sealing rings 44.

Further, the number of faces 26 and the number of curved lips 37 may be varied.

Modifications and variations as would be apparent to a skilled addressee are deemed to be within the scope of the present invention.

The invention claimed is:

1. A container comprising a base and a cap, wherein said base and said cap are arranged to be inter-engaged for forming a hermetic seal, said cap having an outer side wall extending between a lower end of said cap and an upper end of said cap, said base having an upper end and a lower end, said outer side wall of said cap having a longitudinally extending multi-sided upper region adjacent said upper end of said cap, said upper region of said cap being formed with at least three substantially identical lateral faces which are separated from one another by longitudinally extending boundaries and are angularly disposed relative to one another about said side wall of said cap, and said upper end of said base having a multi-sided upper lateral end wall defining an upper aperture having a plurality of outer sides angularly disposed relative to one another about said upper end of said base, said upper aperture corresponding with the shape of said upper region of said outer side wall of said cap, said base comprising a lower chamber arranged for containing a liquid, the arrangement being such that when said cap and said base are fully inter-engaged said chamber is hermetically sealed, and wherein said multi-sided upper region of said outer side wall of said cap is flared progressively outwardly toward said upper end of said cap such that said inter-engaged cap is axially rotatable relative to said base so that said progressively flared multi-sided upper region of said cap engages with said multi-sided upper end wall of said base for causing said cap to rise up over said upper end of said base and to be released from said base for breaking said hermetic seal.

2. A container according to claim 1 wherein said lower end of said cap is arranged for engaging sealingly with said chamber for forming said hermetic seal, said lower end of said engaged cap being spaced from said lower end of said base for defining said hermetically sealed chamber.

3. A container according to claim 2 wherein said chamber is provided with a sealing means and the lower end of said cap is provided with a corresponding sealing means.

4. A container according to claim 1 wherein said multi-sided upper end wall of said base has a plurality of sides having inner ends with curved lips for engagement with said flared upper end of said cap.

5. A container according to claim 4 wherein said lips are radiused.

6. A container according to claim 1 wherein said cap has a handle arranged for enabling said cap to be rotated axially relative to said base.

7. A container according to claim 1 wherein said upper end of said cap has an outwardly extending rim arranged for engaging said upper end of said base when said container is hermetically sealed.

8. A container according to claim 1 wherein said base contains an inner generally circular wall adjacent said lower end thereof, said inner wall defining said chamber.

9. A container according to claim 1 wherein said chamber contains a liquid.

* * * * *